US012753661B2

(12) United States Patent
Stankovic et al.

(10) Patent No.: US 12,753,661 B2
(45) Date of Patent: Oct. 6, 2026

(54) TUBULAR HANDLING WITH SPIDER CONTROL SYSTEM

(71) Applicant: WEATHERFORD TECHNOLOGY HOLDINGS, LLC, Houston, TX (US)

(72) Inventors: Igor Stankovic, Gehrden (DE); Bjoern Thiemann, Hannover (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 18/812,057

(22) Filed: Aug. 22, 2024

(65) Prior Publication Data

US 2026/0009298 A1 Jan. 8, 2026

Related U.S. Application Data

(60) Provisional application No. 63/668,018, filed on Jul. 5, 2024.

(51) Int. Cl.
*E21B 19/10* (2006.01)
*E21B 19/06* (2006.01)

(52) U.S. Cl.
CPC ..... *E21B 19/10* (2013.01); *E21B 19/06* (2013.01)

(58) Field of Classification Search
CPC ..... E21B 19/10
See application file for complete search history.

(56) References Cited

U.S. PATENT DOCUMENTS

| | | | |
|---|---|---|---|
| 4,604,724 A | 8/1986 | Shaginian et al. | |
| 8,136,603 B2 | 3/2012 | Schneider | |
| 8,439,121 B2 | 5/2013 | Nikiforuk et al. | |
| 9,453,377 B2 | 9/2016 | Mosing et al. | |
| 10,513,894 B2 | 12/2019 | Abou-Assaad et al. | |
| 10,676,999 B2 | 6/2020 | Roodenburg et al. | |
| 10,697,257 B2 | 6/2020 | Dewald et al. | |
| 11,448,019 B2 | 9/2022 | Nield et al. | |
| 11,970,915 B2 | 4/2024 | Liess et al. | |
| 2012/0043071 A1 | 2/2012 | Matherne, Jr. et al. | |
| 2012/0152530 A1* | 6/2012 | Wiedecke | E21B 3/022 166/250.01 |

(Continued)

FOREIGN PATENT DOCUMENTS

| | | |
|---|---|---|
| WO | 2011/028786 A2 | 3/2011 |
| WO | 2013/074468 A2 | 5/2013 |

OTHER PUBLICATIONS

SLB Energy Glossary entry for "slips", accessed Jul. 2025 via glossary.slb.com.*

(Continued)

*Primary Examiner* — Blake Michener
(74) *Attorney, Agent, or Firm* — Smith IP Services, P.C.

(57) ABSTRACT

A spider can include a sensor that outputs measurements indicative of a distance between a location on the spider and a floor of a well rig, and a control system that controls actuation of slips of the spider between open and closed positions in response to the measurements. A method can include measuring a distance between a location on a spider and a floor of a well rig, and controlling actuation of slips of the spider between open and closed positions in response to the measuring. A system can include a spider with at least one slip that grips a tubular positioned in the spider, and a sensor that senses a rise of a location on the spider relative to a floor of a well rig.

20 Claims, 5 Drawing Sheets

(56) References Cited

U.S. PATENT DOCUMENTS

| | | | | |
|---|---|---|---|---|
| 2016/0290073 | A1* | 10/2016 | Zheng | E21B 44/00 |
| 2016/0369619 | A1 | 12/2016 | Parmeshwar et al. | |
| 2019/0078401 | A1* | 3/2019 | Knowlton | E21B 19/165 |
| 2020/0278193 | A1* | 9/2020 | Orban | E21B 17/006 |
| 2021/0102454 | A1* | 4/2021 | Jorud | G06Q 50/265 |
| 2021/0277732 | A1* | 9/2021 | Parmeshwar | E21B 19/165 |
| 2022/0333450 | A1* | 10/2022 | Al-Ghamdi | E21B 19/161 |
| 2023/0074177 | A1 | 3/2023 | Owoeye et al. | |
| 2024/0011360 | A1 | 1/2024 | Liess et al. | |
| 2024/0018834 | A1* | 1/2024 | Baker | E21B 19/10 |

OTHER PUBLICATIONS

International Search Report with Written Opinion issued Jul. 22, 2025 for PCT Patent Application No. PCT/IB2025/055108, 11 pages.

* cited by examiner

TUBULAR HANDLING WITH SPIDER CONTROL SYSTEM

CROSS-REFERENCE TO RELATED APPLICATION

This application claims the benefit of the filing date of U.S. provisional application No. 63/668,018 filed on Jul. 5, 2024. The entire disclosure of the prior application is incorporated herein by this reference for all purposes.

BACKGROUND

This disclosure relates generally to equipment utilized and operations performed in conjunction with a subterranean well and, in at least one example described below, more particularly provides for tubular handling with a spider control system.

A spider is used to suspend a tubular (such as, the types known to those skilled in the art as liner, casing, riser, tubing, pipe, screens, etc.) at a well rig. One type of spider includes a slip assembly to grip an outside surface of the tubular. The slip assembly includes slips that are displaced to open and closed positions to release and grip the tubular, respectively.

It will, therefore, be readily appreciated that improvements are continually needed in the art of designing, constructing and utilizing spiders for use with subterranean wells. The present disclosure provides such improvements, which may be used with a wide variety of different types of well rigs.

DETAILED DESCRIPTION

Figure 1:
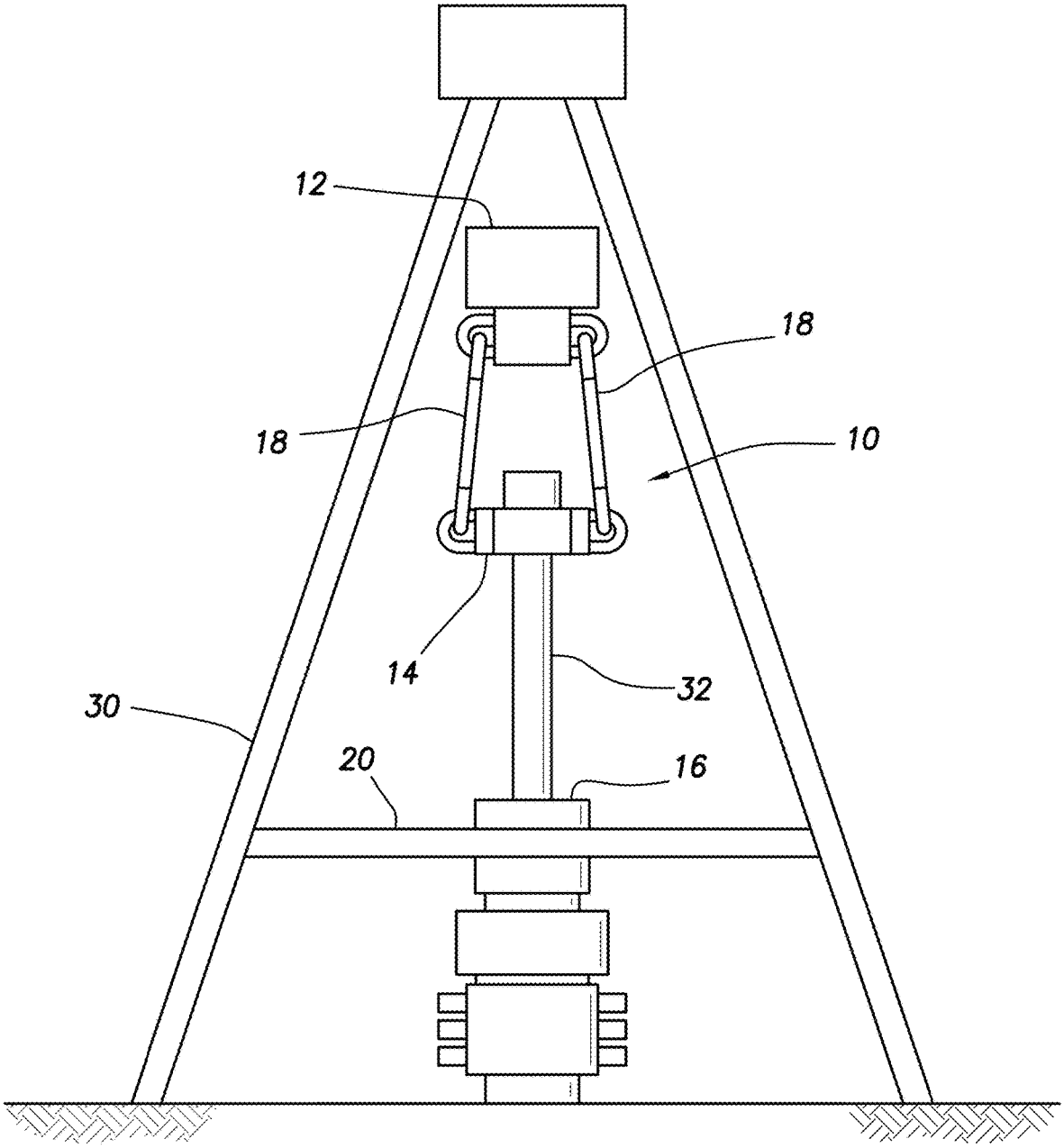
FIG. 1 is a representative partially cross-sectional view of an example of a well system and associated method which can embody principles of this disclosure.

Representatively illustrated in FIG. 1 is a system 10 for use in well operations, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a well rig 30 is used to convey tubulars 32 into and out of a well. As depicted in FIG. 1, the well rig 30 is a land-based rig, but in other examples the rig may be water-based. The tubulars 32 may comprise equipment known to those skilled in the art as casing, liner, riser, tubing, pipe and similar tubular goods, including associated couplings, collars, etc.

To enable the tubulars 32 to be supported by the rig 30, a lifting apparatus 12 is provided with the rig. The lifting apparatus 12 may comprise, for example, a top drive or a draw works.

Bails 18 are connected at their upper ends to the lifting apparatus 12. At their lower ends, the bails 18 are connected to an elevator 14. The elevator 14 is specially configured to grip or otherwise support the tubular 32, so that a weight of the tubular (and any equipment, including additional tubulars, connected below the upper tubular) is supported by the elevator and the connected bails 18 and lifting apparatus 12. The elevator 14, with the bails 18 and lifting apparatus 12, can be used to raise or lower the tubulars 32 through a floor 20 of the rig 30.

At different points in well operations, very different loads may be supported by the lifting apparatus 12, bails 18 and elevator 14. In addition, loads (such as, a weight of a tubular string suspended in the well) can be supported by a spider 16 secured in or on the rig floor 20. The spider 16 includes slips (not visible in FIG. 1) for selectively gripping an outer surface of a tubular 32. The slips have an open position in which the slips are retracted and do not grip the outer surface of the tubular 32, and a closed position in which the slips are extended radially inward into gripping engagement with the outer surface.

When a tubular or tubular string is being supported by the elevator 14 or the spider 16, the tubular or string will be prevented from inadvertently dropping into the well. However, if the spider 16 releases the tubular 32 before it is supported by other equipment (such as the elevator 14), the tubular or string will drop into the well, and costly and time-consuming remedial operations will need to be performed. In the FIG. 1 system 10, the spider 16 is controlled in a manner that helps to ensure that the spider will not release the tubular 32 until after the tubular is supported by other equipment.

Figure 2:
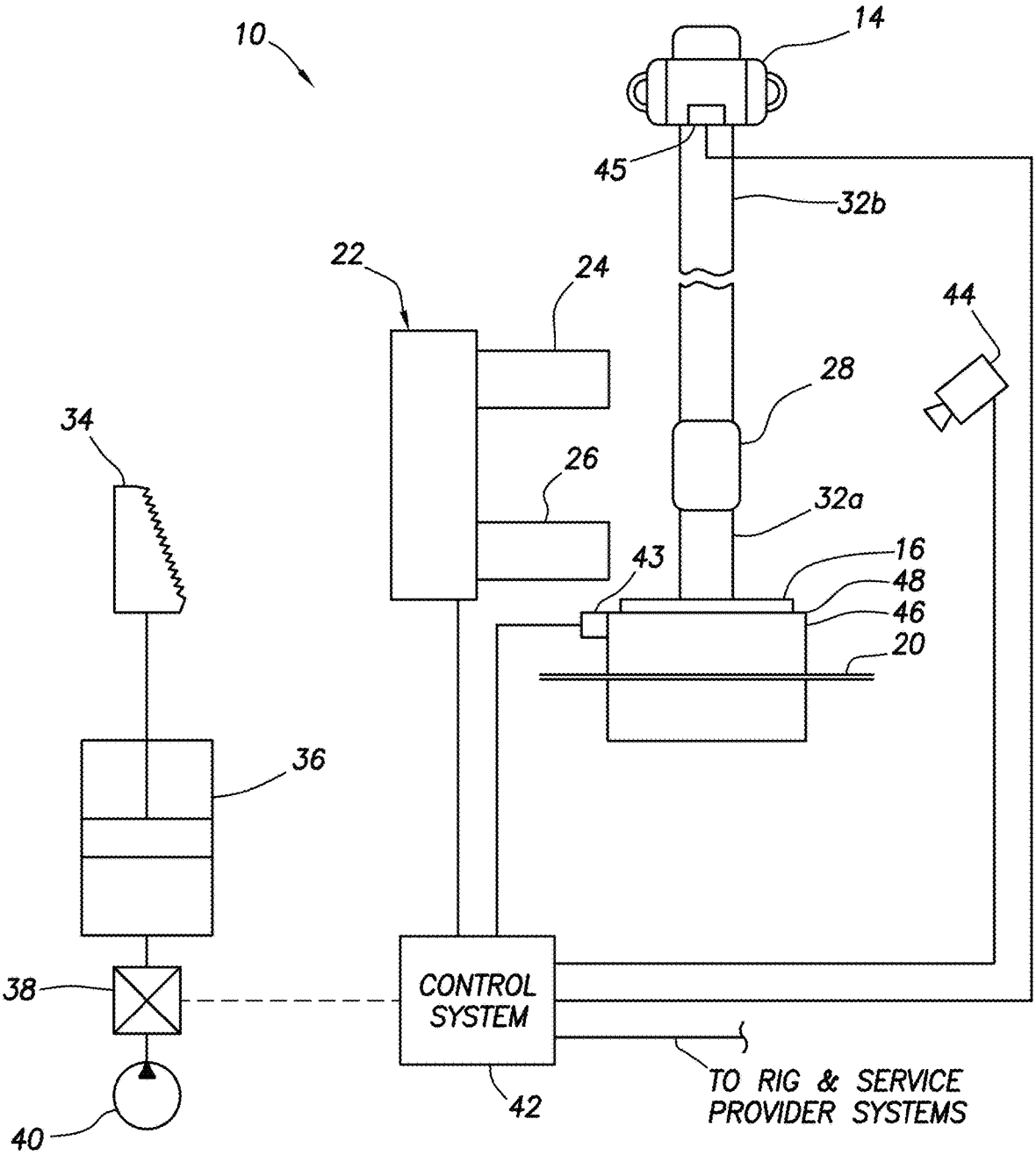
FIG. 2 is a representative schematic view of an example of a spider control system that may be used in the FIG. 1 system and method.

Referring additionally now to FIG. 2, an example of the system 10 in schematic form is representatively illustrated. In this example, lower and upper tubulars 32*a,b* are being supported by the elevator 14 above the spider 16 in the rig floor 20. The tubulars 32*a,b* form an upper portion of a tubular string extending through the rig floor 20 and into the well.

In the FIG. 2 example, a tong assembly 22, including a rotary tong 24 and a backup tong 26, is used to make up and break out connections 28 between the tubulars 32*a,b*. The tong assembly 22 may be used while running in, or tripping out, the tubular string. However, use of the tong assembly 22 is not necessary in the system 10. Other means may be provided for making up and breaking out the connections 28 (such as, a top drive, a rotary table, etc.).

One of the slips 34 is depicted in FIG. 2 apart from the spider 16. However, in practice the slip 34 would be part of the spider 16 and would be displaceable between its open and closed positions by an actuator 36. In this example, the actuator 36 comprises a fluid pressure-operated actuator (such as, a hydraulic or pneumatic actuator). In other examples, other types of actuators may be used (such as, an electrical or magnetic actuator).

A valve assembly 38 is used to operate the actuator 36 by appropriately applying fluid pressure from a pressure source 40 to the actuator. The valve assembly 38 is depicted in very simplified form in FIG. 2, but a more detailed description is provided below for a hydraulic circuit example depicted in FIG. 3.

A control system 42 controls operation of the valve assembly 38 and thereby controls operation of the actuator 36. Thus, the control system 42 controls whether and when the slips 34 are displaced between their open and closed positions.

In the FIG. 2 example, the control system 42 receives measurements output by sensors 43, 44. The sensors 43, 44 are positioned near the rig floor 20 for sensing when a portion of the spider 16 is raised relative to the rig floor. This raising of the portion of the spider 16 is an indication that the weight of the tubulars 32*a,b* (and any tubular string below) is being supported by other equipment (such as, the elevator 14).

In tubular handling operations, the elevator 14 can be raised by the lifting apparatus 12 (see FIG. 1), so that the elevator positively supports the weight of the tubular string. This raising of the elevator 14 (and the supported tubular string) will also cause the portion of the spider 16 to raise relative to the rig floor 20, since the slips 34 are at this point in their closed positions gripping the outer surface of the tubular string.

In the FIG. 2 system 10, the raising of the portion of the spider 16 relative to the rig floor 20 is sensed by the sensors 43, 44. In this example, two sensors 43, 44 are used, but in other examples other numbers of sensors (including one) may be used.

For clarity, in the further description of the system 10 and spider 16, the portion of the spider 16 which is raised relative the rig floor 20 when the weight of the tubular string is supported by other equipment comprises an upper housing 46 of the spider. In other examples, other locations or other portions of the spider 16 may be used instead of, or in addition to, the upper housing 46.

The sensor 43 in this example is secured to the upper housing 46, so that the sensor 43 displaces with the upper housing when it displaces relative to the rig floor 20. The sensor 43 comprises a proximity sensor capable of measuring a distance between the sensor and the rig floor 20, or of sensing whether the distance is less than or greater than a given distance level. For example, the sensor 43 may be an ultrasonic proximity sensor, a laser ranging device, a proximity switch, a Hall effect device, a linear displacement transducer, etc. The scope of this disclosure is not limited to use of any particular type of proximity sensor, or to use of a proximity sensor at all.

In the FIG. 2 example, the sensor 43 can be used to detect when the upper housing 46 is raised relative to the rig floor 20. For example, the measurements of distance between the sensor 43 and the rig floor 20 will increase while the upper housing 46 is raised relative to the rig floor 20.

As another example, the distance measurement will exceed a certain level when the upper housing 46 is raised a given distance relative to the rig floor 20. The distance measurement will be less than that certain level when the upper housing 46 is not raised the given distance relative to the rig floor 20.

If the proximity sensor is mounted to a portion of the spider 16 that is below, instead of above, the rig floor 20, then the measurements of distance between the sensor 43 and the rig floor 20 will decrease while the portion of the spider is raised relative to the rig floor 20. In addition, the distance measurement will be less than a certain level when the upper housing 46 is raised a given distance relative to the rig floor 20, and the distance measurement will exceed that certain level when the upper housing 46 is not raised the given distance relative to the rig floor 20.

The control system 42 can use the measurements provided by the sensor 43 to determine whether and when the slips 34 are actuated to the open or closed position. For example, if the measurements output by the sensor 43 indicate that the upper housing 46 has been raised relative to the rig floor 20, thereby indicating that other equipment is supporting the tubular string weight, the control system 42 can permit the slips 34 to be actuated to their open positions.

As another example, if the measurements output by the sensor 43 indicate that the distance between the sensor 43 and the rig floor 20 has increased, or has increased to at least a certain level, thereby indicating that other equipment is supporting the tubular string weight, the control system 42 can permit the slips 34 to be actuated to their open positions. If the measurements output by the sensor 43 indicate that the distance between the sensor 43 and the rig floor 20 has not increased, or has not increased to at least a certain level, thereby indicating that other equipment is not supporting the tubular string weight, the control system 42 can prevent the slips 34 from being actuated to their open positions.

Communication between the sensor 43 and the control system 42 may be by wired or wireless transmission. For example, the sensor 43 can include a BLUETOOTH™ or other type of short or long range wireless transmitter.

The control system 42 in this example can include volatile and non-volatile memory for storing the sensor 43, 44 measurements, software, instructions, other data, etc. The control system 42 can also include components such as processors, power supplies, programmable logic controllers, input and output devices, communication hardware and software, etc. The control system 42 may be in wired or wireless communication with service provider and/or rig 30 control systems, for example, for data sharing or operational control purposes. The scope of this disclosure is not limited to use of any particular type of control system, or to any particular combination of components in the control system 42.

The sensor 44 in the FIG. 2 example comprises a visual sensor or camera. The sensor 44 is positioned so that the sensor can view the rig floor 20 and a location of interest on the spider 16.

In some examples, the sensor 44 may also be used for other purposes. In the FIG. 2 example, the sensor 44 provides data used to measure a height of the connection 28 above the rig floor 20, so that the tong assembly 22 is appropriately positioned to make up or break out the connection.

The sensor 44 may be used in the FIG. 2 system 10 to determine whether the upper housing 46 (or other location of interest on the spider 16) has been raised, or has been raised to a certain level, relative to the rig floor 20. For example, the location of interest can be a relatively conveniently identified visible feature on the spider 16 that is raised when the weight of the tubular string is supported by other equipment. This feature could, for example, be an edge 48 on the outer housing 46 that is visible to the sensor 44, a visual token mounted at the location of interest (see FIG. 5), or another feature.

The output of the sensor 44 is used by the control system 42 to control whether the slips 34 should be actuated to their open or closed positions. The sensor 44 may include processing equipment for processing the measurements generated by the sensor. The processing can include identifying specific features (such as, the rig floor 20 and the feature at the location on the spider 16) as represented in the measurements. In some examples, artificial intelligence may be used to train the processing equipment to identify particular structures and their locations in space, as represented in the measurements. Alternatively, or in addition, the processing may be performed by the control system 42.

In the FIG. 2 example, the sensor 44 can be used to detect when the upper housing 46 is raised relative to the rig floor 20. For example, the measurements of distance between the edge 48 (or another location on the spider 16) and the rig floor 20 will increase while the upper housing 46 is raised relative to the rig floor 20.

As another example, the distance measurement will exceed a certain level when the upper housing 46 is raised a given distance relative to the rig floor 20. The distance measurement will be less than that certain level when the upper housing 46 is not raised the given distance relative to the rig floor 20.

The control system 42 can use the measurements provided by the sensor 44 to determine whether and when the slips 34 are actuated to the open or closed position. For example, if the measurements output by the sensor 44 indicate that the upper housing 46 has been raised relative to the rig floor 20, thereby indicating that other equipment is supporting the tubular string weight, the control system 42 can permit the slips 34 to be actuated to their open positions.

As another example, if the measurements output by the sensor 44 indicate that the distance between the edge 48 (or another location on the spider 16) and the rig floor 20 has increased, or has increased to at least a certain level, thereby indicating that other equipment is supporting the tubular string weight, the control system 42 can permit the slips 34 to be actuated to their open positions. If the measurements output by the sensor 44 indicate that the distance between the edge 48 and the rig floor 20 has not increased, or has not increased to at least a certain level, thereby indicating that other equipment is not supporting the tubular string weight, the control system 42 can prevent the slips 34 from being actuated to their open positions.

The sensors 43, 44 in the FIG. 2 example may be used alternatively, independently, or in combination with each other. For example, the control system 42 may be configured so that the slips 34 can only be actuated to their open positions if the outputs of both of the sensors 43, 44 indicate that the weight of the tubular string is being supported by other equipment.

Either of the sensors 43, 44 may be a "primary" sensor, in that the output of a primary sensor is given greater weight in determining whether a condition has been satisfied. Either of the sensors 43, 44 may be a "backup" sensor, in that the output of a backup sensor is used when an output of another sensor is unavailable, unusable, unreliable, etc.

It is not necessary that the system 10 include both of the sensors 43, 44, and other types of sensors may be used, in keeping with the scope of this disclosure. In some examples, outputs of other sensors may also be used to control operation of the spider 16. For example, a sensor 45 may be used to detect a condition, orientation or state of the elevator 14.

In one example, the sensor 45 may be used to sense whether the elevator 14 is open or closed. The control system 42 can prevent the spider 16 from being opened (prevent the slips 34 from being actuated to their open positions), unless the sensor 45 indicates that the elevator 14 is closed. The spider 16 cannot be opened if the sensor 45 indicates that the elevator is open.

In another example, information received by the control system 42 from the tong assembly 22 and/or the sensor 44 may be used to determine whether the tubular connection 28 has been properly made up. The control system 42 can prevent the spider 16 from being opened, unless the sensor 45 indicates that the elevator 14 is closed, and the tong assembly 22 and/or the sensor 44 indicates that the tubular connection 28 has been made up. The spider 16 cannot be opened if the sensor 45 indicates that the elevator is open, or if the tong assembly 22 and/or the sensor 44 indicates that the tubular connection 28 has not been made up.

In another example, the sensor 45 may be used to sense whether the elevator 14 is vertical (the elevator will be vertical if the tubulars 32 are being supported by the elevator). The control system 42 can prevent the spider 16 from being opened, unless the sensor 45 indicates that the elevator 14 is vertical. The spider 16 cannot be opened if the sensor 45 indicates that the elevator is not vertical.

Similarly, in another example, a sensor may be used to sense whether the tubulars 32 are being supported by equipment other than the spider 16. For example, the sensor 45 could comprise a load sensor that senses load supported by the elevator 14, or that senses load supported by a torque sub (such as, if a top drive is used). The control system 42 can prevent the spider 16 from being opened, unless the load sensor indicates that the tubulars 32 are being supported by other equipment. The spider 16 cannot be opened if the load sensor indicates that the tubulars 32 are not being supported by the other equipment.

In some examples, the control system 42 can compare and evaluate data received from the sensors 43, 44, 45 and other equipment (such as, the tong assembly 22, a radio frequency identification (RFID) tag reader, etc.). For example, if the output of the sensor 44 is inconsistent with information received from the RFID tag reader, the control system 42 may prevent opening of the spider 16.

Figure 3:
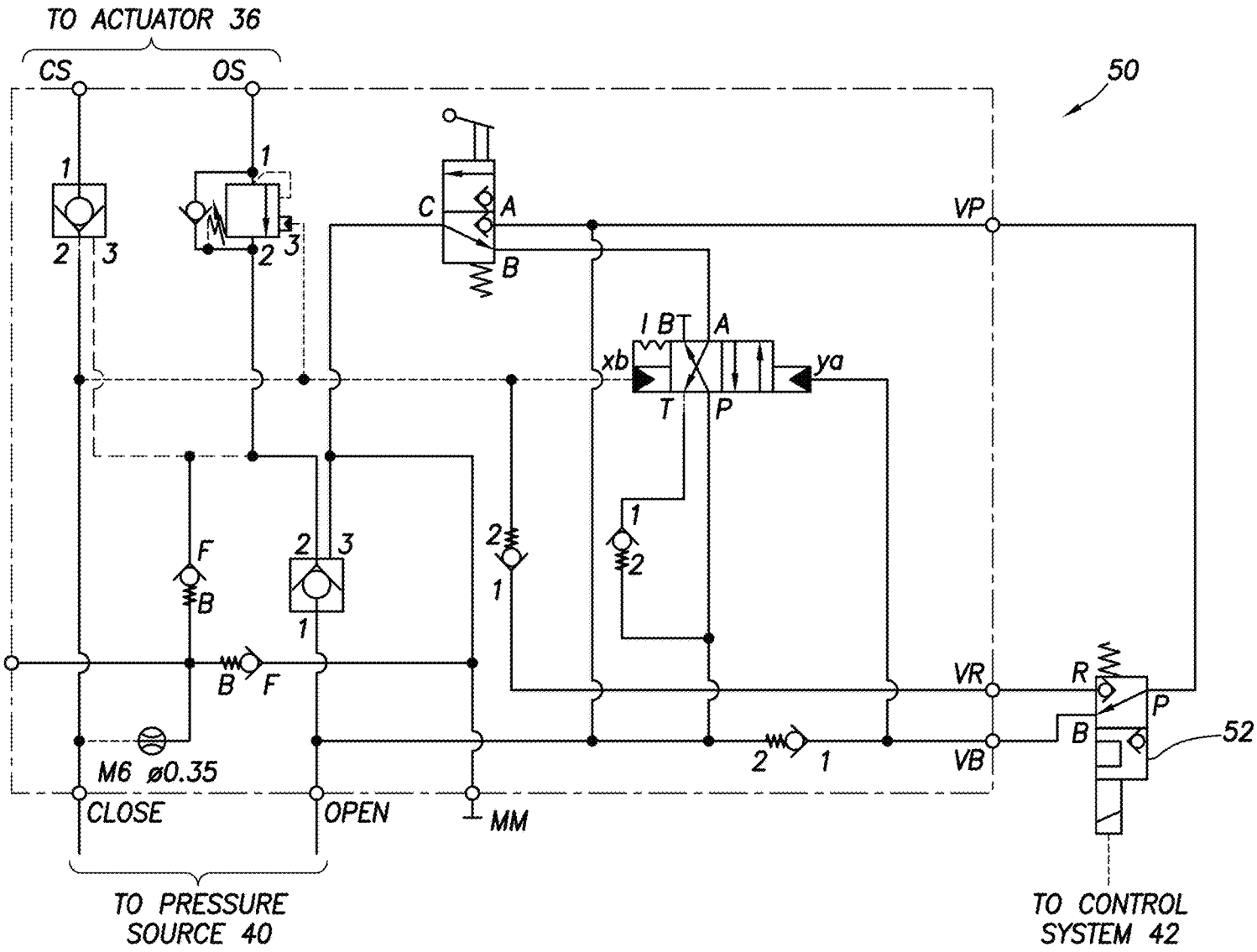
FIG. 3 is a representative schematic view of an example of a hydraulic circuit that may be used with the spider control system.

Referring additionally now to FIG. 3, a schematic view of an example of a hydraulic circuit 50 that may be used with the spider control system 42 is representatively illustrated. The hydraulic circuit 50 may be used in the FIG. 2 system 10 and method, or it may be used with other systems or methods. For convenience, the hydraulic circuit 50 is described below as it may be used with the FIG. 2 system 10 and method.

In the FIG. 2 system 10 and method, the hydraulic circuit 50 may comprise part of the valve assembly 38. In that case, the pressure source 40 transmits fluid pressure to the hydraulic circuit 50 close and open ports when it is desired to displace the slips 34 to their closed and open positions, respectively. The fluid pressure is transmitted to the hydraulic circuit 50 CS and OS ports to operate the actuator 36 and thereby displace the slips 34 to their closed and open positions, respectively, under control of the control system 42.

In this example, the control system 42 controls operation of a valve 52 connected in the hydraulic circuit 50. In a deactivated configuration depicted in FIG. 3, the valve 52 prevents transmission of fluid pressure from the open port to the OS port of the hydraulic circuit 50, thereby preventing displacement of the slips 34 to the open positions. The control system 42 may deactivate the valve 52 when the weight of the tubular string is not being supported by other equipment, such as, when the sensor 43, 44 output measurements do not indicate that a portion of the spider 16 has been raised, or raised a sufficient distance, relative to the rig floor 20.

In an activated configuration, the valve 52 permits transmission of fluid pressure from the open port to the OS port of the hydraulic circuit 50, thereby permitting displacement of the slips 34 to the open positions. The control system 42 may activate the valve 52 when the weight of the tubular string is being supported by other equipment, such as, when the sensor 43, 44 output measurements indicate that a portion of the spider 16 has been raised, or raised a sufficient distance, relative to the rig floor 20.

Figure 4:
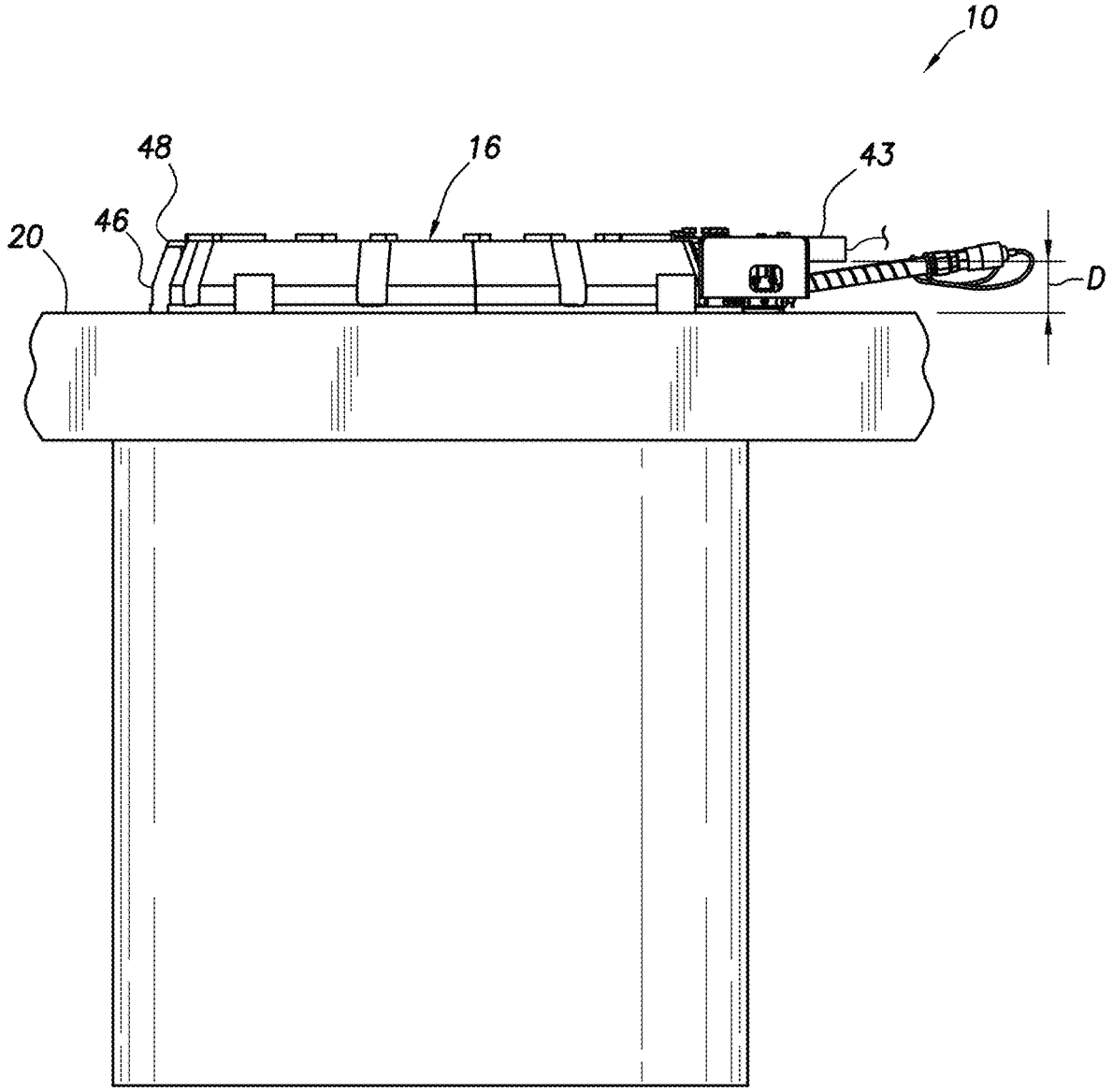
FIG. 4 is a representative side view of an example of a spider in a rig floor.

Referring additionally now to FIG. 4, a side view of an example of a spider 16 in a rig floor 20 is representatively illustrated. The FIG. 4 spider 16 may be used in the FIG. 2 system 10 and method, or it may be used with other systems and methods. For convenience, the spider 16 is described below as it may be used with the FIG. 2 system 10 and method.

As depicted in FIG. 4, the spider 16 is in a closed configuration, with the slips 34 therein at their radially inwardly extended closed gripping positions. A sensor 43 is mounted on the upper housing 46. The sensor 43 is capable of measuring a distance D between the sensor and the rig floor 20, or at least indicating whether the distance is greater than or less than a certain level.

The FIG. 4 spider 16 utilizes the sensor 43, but a system 10 incorporating the FIG. 4 spider 16 could also, or alternatively, utilize the sensor 44 (see FIG. 2). For example, the sensor 44 could be used to detect and identify the edge 48 on the upper housing 46 and to determine a distance between the edge and the rig floor 20.

Figure 5:
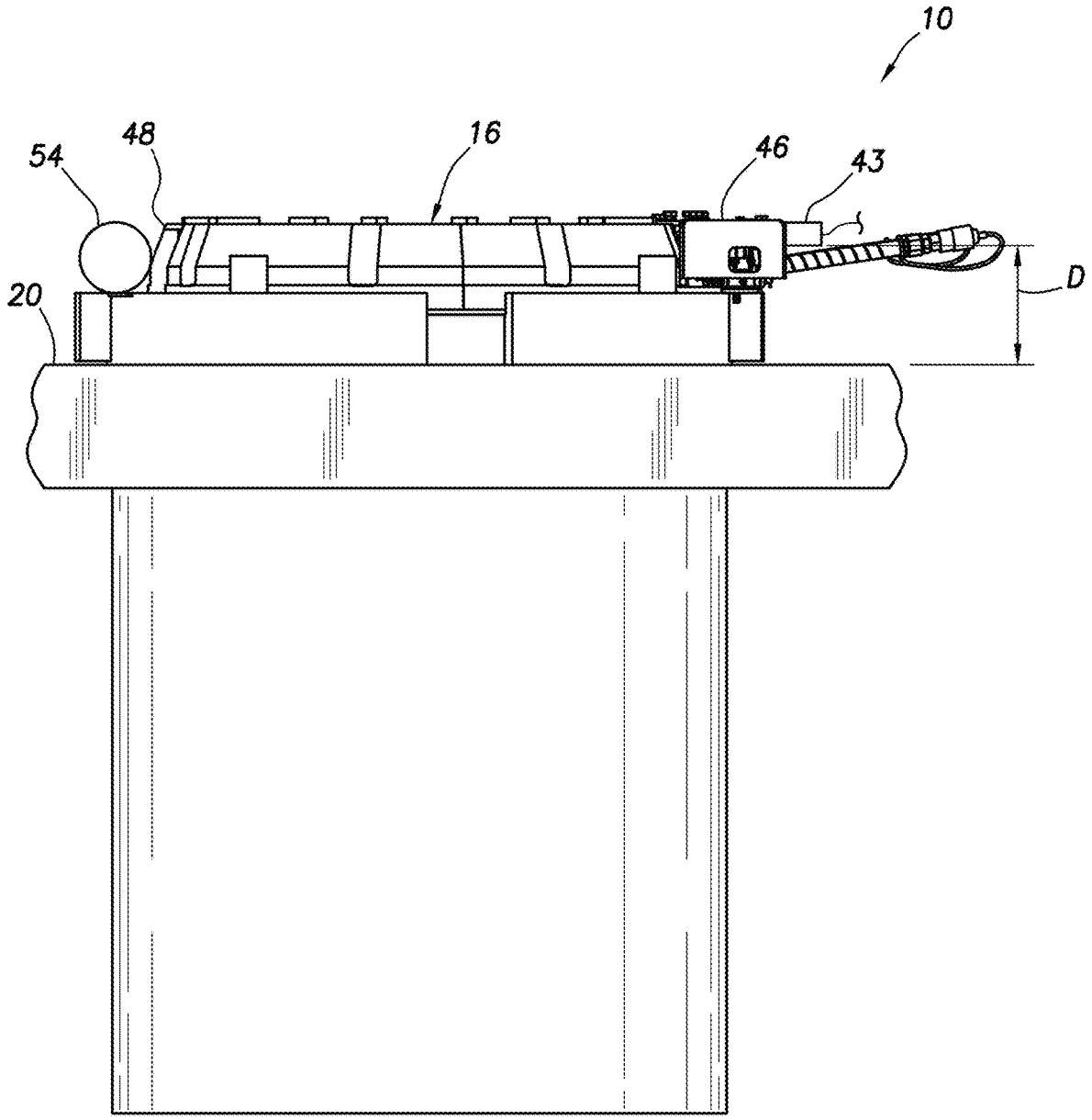
FIG. 5 is a representative side view of the spider in a raised position relative to the rig floor.

Referring additionally now to FIG. 5, a side view of the FIG. 4 spider 16 in a raised position relative to the rig floor 20 is representatively illustrated. In this view, the upper housing 46 has been raised. As a result, the sensor 43 mounted on the upper housing 46 outputs measurements indicative of the upper housing being raised. For example, the sensor 43 can output a measurement of the distance D that is greater than the measured distance when the spider 16 was in the FIG. 4 closed configuration.

The sensor 44 (see FIG. 2) can be used to identify a feature (such as the edge 48 of the upper housing 46) at a location on a portion of the spider 16 that is raised when the weight of the tubulars 32 is being supported by the other equipment. If the edge 48 is raised, this can be detected using the image data generated by the sensor 44 and with appropriate image processing.

As another example, a visual token 54 can be mounted on the portion of the spider 16 that is raised when the weight of the tubular 32 is being supported by the other equipment. The visual token 54 is preferably relatively easily identified in the image data generated by the sensor 44. For example, the visual token 54 can comprise an easily identifiable shape (such as, a sphere, a pyramid, etc.), an easily identifiable color (such as, a color not typically used near a rig floor), illumination, or other easily identifiable characteristic. If the token 54 is raised, this can be detected using the image data generated by the sensor 44 and with appropriate image processing.

As depicted in FIG. 5, a weight of the tubulars 32 or a tubular string extending through the spider 16 is being supported by other equipment (such as, the elevator 14, a top drive, etc.). When the tubulars 32 are fully supported by the other equipment, the other equipment can raise the tubulars and the upper housing 46 (or other portion of the spider 16). This raising can be detected using the outputs of the sensors 43, 44 and can be used to control operation of the spider 16 as described above.

It may now be fully appreciated that the above disclosure provides significant advancements to the art of designing, constructing and utilizing spiders with subterranean wells. In examples described above, the spider 16 cannot be actuated to an open configuration, unless the weight of a tubular 32 or tubulars 32*a,b* is being supported by other equipment.

The above disclosure provides to the art a spider 16 for use with a subterranean well. In one example, the spider 16 can comprise at least one sensor 43, 44 configured to output measurements indicative of a distance D between a location on the spider 16 and a floor 20 of a well rig 30, and a control system 42 configured to control actuation of slips 34 of the spider 16 between open and closed positions in response to the measurements.

The sensor 43 may comprise at least one of a proximity sensor, a laser ranging device, a proximity switch, a Hall effect device, and/or a linear displacement transducer. The sensor 43 may be mounted at the location on the spider 16. The sensor 44 may comprise a camera.

The control system 42 may be configured to control application of pressure to an actuator 36 configured to displace the slips 34 between the open and closed positions.

The control system 42 may be configured to prevent the actuator 36 from displacing the slips 34 to the open position if the measurements are less than a predetermined distance level. The control system 42 may be further configured to permit the actuator 36 to displace the slips 34 to the open position if the measurements are greater than the predetermined distance level.

The control system 42 may be configured to permit displacement of the slips 34 to the open position in response to an increase in the measurements.

The above disclosure also provides to the art a method for use with a subterranean well. In one example, the method can comprise: measuring a distance D between a location on a spider 16 and a floor 20 of a well rig 30; and controlling actuation of slips 34 of the spider 16 between open and closed positions in response to the measuring step.

The measuring step may include mounting a sensor 43 on the spider 16, the sensor comprising at least one of the group consisting of a proximity sensor, a laser ranging device, a proximity switch, a Hall effect device and a linear displacement transducer. The measuring step may include positioning a camera 44 so that the rig floor 20 and the location on the spider 16 are visible to the camera 44. The measuring step may include securing a visual token 54 at the location on the spider 16.

The step of controlling actuation may include controlling application of pressure to an actuator 36 that displaces the slips 34 between the open and closed positions.

The step of controlling actuation may include permitting the slips 34 to displace to the open position when the distance D is greater than a predetermined distance level. The step of controlling actuation may include preventing the slips 34 from displacing to the open position when the distance D is less than the predetermined distance level.

A system 10 for use with a subterranean well is also described above. In one example, the system 10 can comprise a spider 16 including at least one slip 34 configured to grip a tubular 32 positioned in the spider 16, and at least one sensor 43, 44 configured to sense a rise or elevation of a location on the spider 16 relative to a floor 20 of a well rig 30.

The spider 16 may also include an actuator 36 configured to displace the slip 34 between open and closed positions. The actuation of the slip 34 to the open position may be prevented if a distance D between the location on the spider 16 and the rig floor 20 is less than a predetermined distance level. The actuation of the slip 34 to the open position may be permitted if a distance between the location on the spider 16 and the rig floor 20 is greater than a predetermined distance level.

The "at least one" sensor 43, 44 may be selected from the group consisting of a proximity sensor, a laser ranging device, a proximity switch, a Hall effect device, a linear displacement transducer and a camera.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A spider for use with a subterranean well, the spider comprising:

at least one sensor which directly senses a distance between a location on the spider and a floor of a well rig, in which the distance changes when at least a portion of a weight supported by the spider is transferred from the spider while slips of the spider are in a closed position; and a control system configured to control actuation of the slips of the spider between an open position and the closed position based on the distance.

2. The spider of claim 1, in which the sensor comprises at least one of the group consisting of a proximity sensor, a laser ranging device, a proximity switch, a Hall effect device and a linear displacement transducer.

3. The spider of claim 2, in which the sensor is mounted at the location on the spider.

4. The spider of claim 1, in which the sensor comprises a camera.

5. The spider of claim 1, in which the control system is further configured to control application of pressure to an actuator configured to displace the slips between the open and closed positions.

6. The spider of claim 5, in which the control system is further configured to prevent the actuator from displacing the slips to the open position if the distance is less than a predetermined distance level.

7. The spider of claim 6, in which the control system is further configured to permit the actuator to displace the slips to the open position if the distance is greater than the predetermined distance level.

8. The spider of claim 1, in which the control system is further configured to permit displacement of the slips to the open position if the distance is less than a predetermined distance level.

9. A method for use with a subterranean well, the method comprising:

directly measuring a distance between a location on a spider and a floor of a well rig, in which the distance changes when at least a portion of a weight supported by the spider is transferred from the spider while slips of the spider are in a closed position; and controlling actuation of the slips of the spider between an open position and the closed position based on the distance.

10. The method of claim 9, in which the measuring comprises mounting a sensor on the spider, the sensor comprising at least one of the group consisting of a proximity sensor, a laser ranging device, a proximity switch, a Hall effect device and a linear displacement transducer.

11. The method of claim 9, in which the measuring comprises positioning a camera so that the rig floor and the location on the spider are visible to the camera.

12. The method of claim 11, in which the measuring further comprises securing a visual token at the location on the spider.

13. The method of claim 9, in which the controlling actuation comprises controlling application of pressure to an actuator that displaces the slips between the open and closed positions.

14. The method of claim 9, in which the controlling actuation comprises permitting the slips to displace to the open position when the distance is greater than a predetermined distance level.

15. The method of claim 14, in which the controlling actuation further comprises preventing the slips from displacing to the open position when the distance is less than the predetermined distance level.

16. A system for use with a subterranean well, the system comprising:

a spider configured to grip a tubular positioned in the spider; and at least one sensor which directly senses displacement of a location on the spider relative to a floor of a well rig caused by transfer of at least a portion of a weight of the tubular from the spider while the spider is in gripping engagement with the tubular.

17. The system of claim 16, in which the spider further comprises an actuator configured to displace slips of the spider between open and closed positions.

18. The system of claim 17, in which actuation of the slips to the open position is prevented if a distance between the location on the spider and the rig floor is less than a predetermined distance level.

19. The system of claim 18, in which the actuation of the slips to the open position is permitted if the distance between the location on the spider and the rig floor is greater than the predetermined distance level.

20. The system of claim 16, in which the at least one sensor is selected from the group consisting of a proximity sensor, a laser ranging device, a proximity switch, a Hall effect device, a linear displacement transducer and a camera.

* * * * *